United States Patent [19]

Peterson, III

[11] Patent Number: 5,038,854

[45] Date of Patent: Aug. 13, 1991

[54] HEAT EXCHANGER ASSEMBLY

[75] Inventor: Bernard A. Peterson, III, Dowagiac, Mich.

[73] Assignee: Modine Manufacturing Company, Racine, Wis.

[21] Appl. No.: 581,234

[22] Filed: Sep. 12, 1990

[51] Int. Cl.[5] ..... F28F 7/00

[52] U.S. Cl. ..... 165/76; 165/125; 62/507

[58] Field of Search ..... 165/46, 125, 76, 169; 62/507, 508

[56] References Cited

U.S. PATENT DOCUMENTS

| | | | |
|---|---|---|---|
| 2,260,594 | 10/1941 | Young | 165/125 |
| 2,458,159 | 1/1949 | Goldthwaite | 165/125 X |
| 2,478,137 | 8/1949 | Timmer | 62/508 |
| 2,618,257 | 11/1952 | Berkman | 165/46 X |
| 2,625,804 | 1/1953 | Patch et al. | 165/46 X |
| 2,823,522 | 2/1958 | Collins | 165/169 X |
| 2,863,645 | 12/1958 | Spieth | 165/125 X |
| 3,163,996 | 1/1965 | Koch | 165/169 X |
| 3,260,305 | 7/1966 | Leonoard et al. | 165/67 |
| 4,213,498 | 7/1980 | Vandenbossche | 165/136 |
| 4,340,015 | 7/1982 | Wright et al. | 165/122 |

FOREIGN PATENT DOCUMENTS

| | | | |
|---|---|---|---|
| 61-190289 | 8/1986 | Japan | 165/46 |

*Primary Examiner*—Allen J. Flanigan

*Attorney, Agent, or Firm*—Wood, Phillips, Mason, Recktenwald & VanSanten

[57] ABSTRACT

A heat exchanger is provided which a generally planar heat exchanger element is bent about a central axis into a generally cylindrical shape. Brackets are attached to each of two end surfaces of the heat exchanger element. The brackets each comprise first, second and third portions which cooperate with each other to form an interlocking association that maintains the end portions of the heat exchanger in a preselected relationship. The third portions of the two brackets are each bent at a preselected angle relative to the second portion of the associated bracket. Each of the third portions of the two brackets are shaped to receive the third portion of the other bracket in an interlocking manner that is self attaching and self holding. By compressing the diameter of the generally cylindrical heat exchanger from its relaxed shape, with a corresponding decrease in the effective diameter of the heat exchanger, the third portions of the brackets are caused to move toward and past each other. When moved past each other, they snap into position to hold each other in a particular position and, as a result, to maintain a precise spatial relationship between the two end surfaces of the heat exchanger.

11 Claims, 8 Drawing Sheets

HEAT EXCHANGER ASSEMBLY

BACKGROUND OF THE INVENTION

1. Field of the Invention

The present invention is generally related to heat exchanger assemblies and, more particularly, to heat exchanger assemblies which are formed by bending a planar heat exchanger element into a generally cylindrical shape and connecting two end surfaces of the generally cylindrical heat exchanger element together with specially formed brackets.

2. Description of the Prior Art

Many different types of heat exchanger coils are well known to those skilled in the art. For example, planar heat exchanger assemblies are commonly used in condensers of air conditioning systems. It is also known to combine planar assemblies to form A-coils that are well known for use as evaporators in air conditioning systems. For certain applications, it is also known to bend a generally planar heat exchanger element into a cylindrical shape and direct an air flow radially through the heat exchanger. This type of cylindrical heat exchanger assembly has been used for many years in condenser applications for home air conditioning systems and, more recently, cylindrical evaporators have been developed for inclusion within the plenum chamber of a furnace for use as an evaporator in an air conditioning system.

When planar coils are connected together to form A-coils, they are typically attached to each other or to additional plate components with sheet metal screws or other mechanical fastening techniques. When planar coils are bent to form cylindrical heat exchanger assemblies, opposing end surfaces of the assembly are attached to each other using an intermediate plate surface that is mechanically attached to both brackets on opposing end surfaces of the bent heat exchanger. Although certain non-heat exchanging components have been manufactured which utilize brackets that are shaped to be received in locking association when disposed proximate to each other and placed under a separating force, this technique has not been applied to heat exchangers. Instead, known methods for attaching the opposing end surfaces of cylindrical heat exchangers utilize additional components, such as connector plates, attached between opposing brackets with mechanical fasteners used to connect each bracket to the connector plate.

U.S. Pat. No. 4,340,015, which issued to Wright et al on July 20, 1982, discloses the use of a fastener strip that is shaped to receive specifically bent end portions of a heat exchanger condenser cover. It provides an apparatus for encasing a heat exchanger unit. A wrapper is disclosed which comprises solid portions for structural support of the heat exchanger unit and fastening means including closure means formed on each end of the wrapper with a fastener strip which co-operates with the closure means to secure the wrapper in an appropriate position. While disclosing interlocking bent portions of sheet metal components, this patent requires the use of an additional separate component, such as its fastener strip, to maintain opposing ends of a cover in a predetermined relationship to each other.

U.S. Pat. No. 2,625,804, which issued to Patch et al on Jan. 20, 1953, discloses an over-center latch for maintaining the end surfaces of a cooler band in a predetermined position and maintained the cooler band in a restrictive association with a barrel in a barrel cooling apparatus. The invention relates to a cooling and dispensing device for beverages and, more particularly, describes a device for holding a barrel of beverage in place within the cooling apparatus.

U.S. Pat. No. 3,260,305, which issued to Leonard et al on July 12, 1966, describes a folded radiator design for use in association with a space satellite power plant. The radiators are capable of being wrapped around a generally cylindrical assembly and then unfolded to extend radially away from the cylindrical assembly. This patent does not disclose a means for interlocking the opposing end surfaces of a generally cylindrical heat exchanger.

The field of heat exchanger technology can be significantly enhanced by providing a means for maintaining the end surfaces of a cylindrical heat exchanger in a predetermined association with each other while also simplifying the manufacturing procedure and reducing the total number of components and the total cost required to form a generally cylindrical heat exchanger from a planar heat exchanger element.

SUMMARY OF THE INVENTION

The present invention provides a heat exchanger assembly in which a planar heat exchanger element is bent to form a generally cylindrical assembly with end surfaces that are spaced apart in parallel association with each other. In addition, the present invention provides a simplified means for attaching the end surfaces to each other in such a way that they are maintained in a predetermined configuration. In addition, the present invention provides means for accomplishing these goals with a significantly reduced number of components and also makes possible a simplified procedure of assembly that reduces the number of fixtures and tools required for attaching the two end surfaces together.

In a preferred embodiment of the present invention, a heat exchanger assembly comprises a heat exchanger element having two end surfaces, wherein a planar element is bent to form a generally cylindrical member with the end surfaces disposed in a parallel association with each other. In addition, first and second mounting brackets are attached to first and second ones of the two end surfaces. Each of the mounting brackets is provided with first, second and third portions. The first portions of each of the mounting brackets are attached to an associated one of the two end surfaces and a second portion of each of the brackets extends from the first portion at a preselected angle. A third portion of each of the brackets extends from the second portion of the bracket at a second preselected angle. The third portions of the two brackets are disposed in generally opposite directions from each other to form an interlocking arrangement between the brackets. In a preferred embodiment of the present invention, the second preselected angle is between 0° and 90° inclusively, with a most preferred angle being between 0° and 45° inclusively. The generally cylindrical member of the assembly is formed to have a relaxed shape that disposes the end surfaces of the heat exchanger with a space between them. The bent heat exchanger member is deformable, by the application of a compressive force which reduces the effective diameter of the cylinder, to cause the third portions of the two brackets to move into interlocking association with each other. When the compressive force is released, the heat exchanger moves partially back toward its relaxed position and causes the third portions of the two brackets to lock into each other and hold the heat exchanger assembly in a generally cylindrical shape.

The present invention reduces the number of components, and therefore the cost of the assembly, by removing the need for an intermediate plate to be attached mechanically to both of the end brackets. Instead of requiring a plurality of sheet metal screws, or alternative fastening devices, the two end brackets are shaped to receive each other in an interlocking association and the natural forces existing within the heat exchanger structure, which tend to cause the heat exchanger to move toward its relaxed shape, naturally hold the two brackets together in a restrictive manner and prevent the heat exchanger assembly from moving into a non-cylindrical shape larger than that which is intended. No additional fastening devices, such as sheet metal screws, are required to hold the two brackets together and, as a result, to hold the end surfaces of the heat exchanger element in a appropriate relationship with each other.

BRIEF DESCRIPTION OF THE DRAWING

The present invention will be more fully understood from a reading of the description of the preferred embodiment in conjunction with the drawing, in which.

DESCRIPTION OF THE PREFERRED EMBODIMENT

Figure 1:
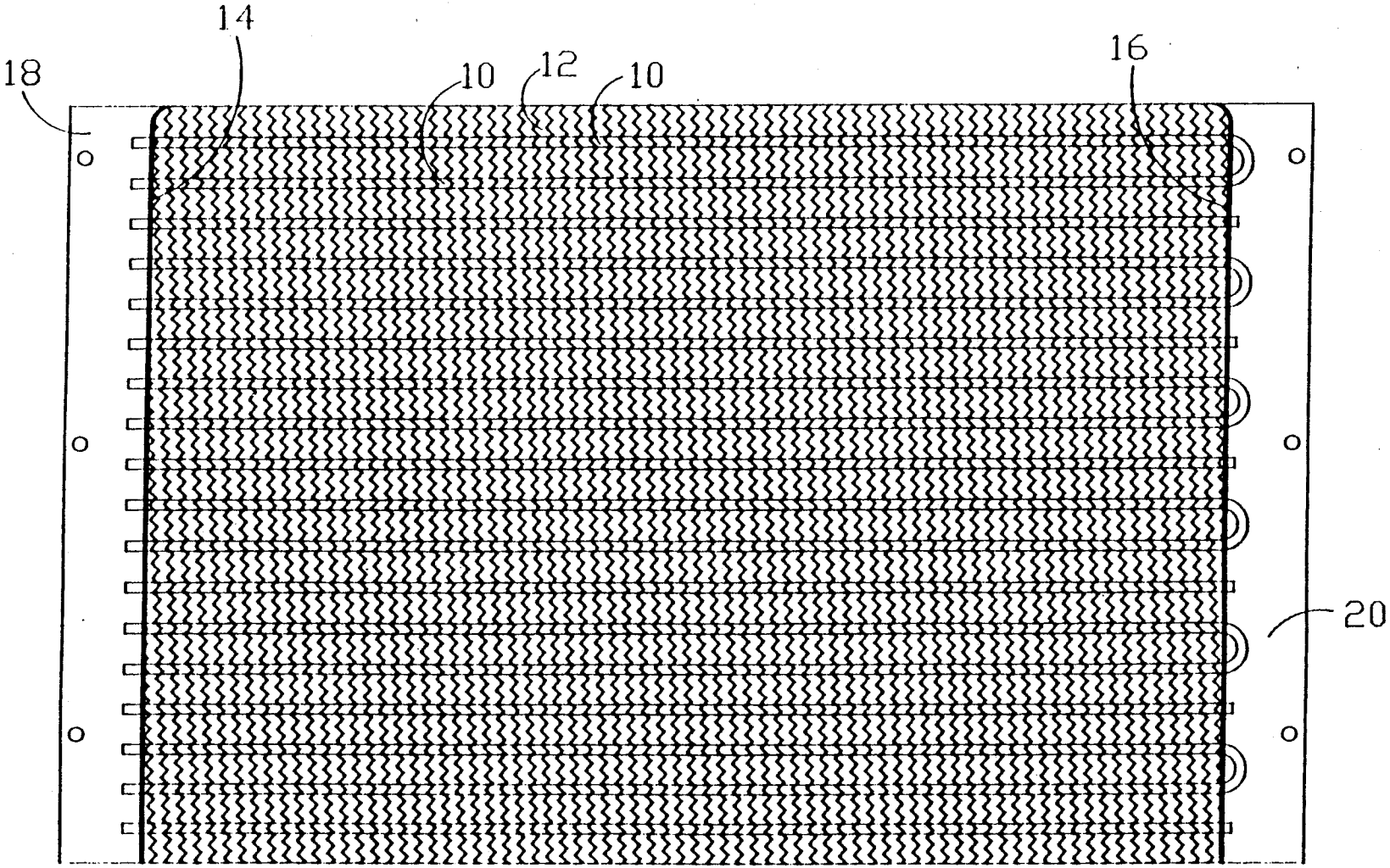
FIG. 1 shows a generally planar heat exchanger element of the prior art comprising a plurality of tubes connected to a plurality of heat exchanger plates, or fins.

Throughout the description of the preferred embodiment, like components will be referred to with like reference numerals.

FIG. 1 shows a planar heat exchanger that comprises a plurality of heat exchanger tubes 10 disposed in a generally parallel association with each other. In addition, a plurality of heat exchanger plates 12, or fins, are associated in thermal communication with the plurality of tubes 10. The heat exchanger element shown in FIG. 1 has two end surfaces, 14 and 16. Each end surface is provided with a bracket. For example, end surface 14 is provided with a bracket 18 and end surface 16 is provided with a bracket 20. Each of the brackets, 18 and 20, are attached to their respective end surfaces, 14 and 16.

Figure 2:
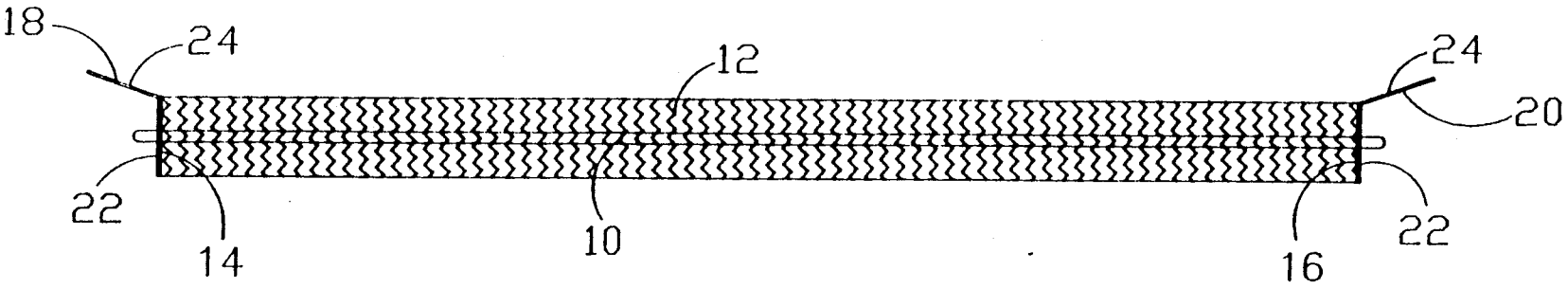
FIG. 2 is a side view of FIG. 1 showing end brackets attached to end surfaces of the heat exchanger element.

FIG. 2 shows an end view of the heat exchanger element of FIG. 1. As can be seen, one row of heat exchanger tubes 10 is provided and connected in thermal communication with a plurality of heat exchanger fins 12. While more than one row of heat exchanger tubes can be used, it is advantageous to use a single row of tubes 10 so that the bending of the heat exchanger element, as will be described below, is facilitated. As can also be seen in FIG. 2, the brackets, 18 and 20, are attached to the end surfaces of the heat exchanger element. As will be described in greater detail below, the end brackets are each made to comprise first, second and third portions in a preferred embodiment of the present invention. However, it should be understood that the heat exchanger element shown in FIGS. 1 and 2 is drawn to represent the type of heat exchanger element that is well known to those skilled in the art and which does not comprise brackets that are shaped in accordance with the present invention. The prior art brackets shown in FIGS. 1 and 2 comprise two straight segments. A first segment 22 is attached to each of the ends of the heat exchanger element and another segment 24 extends at a preselected angle from the first segment.

Figure 3:
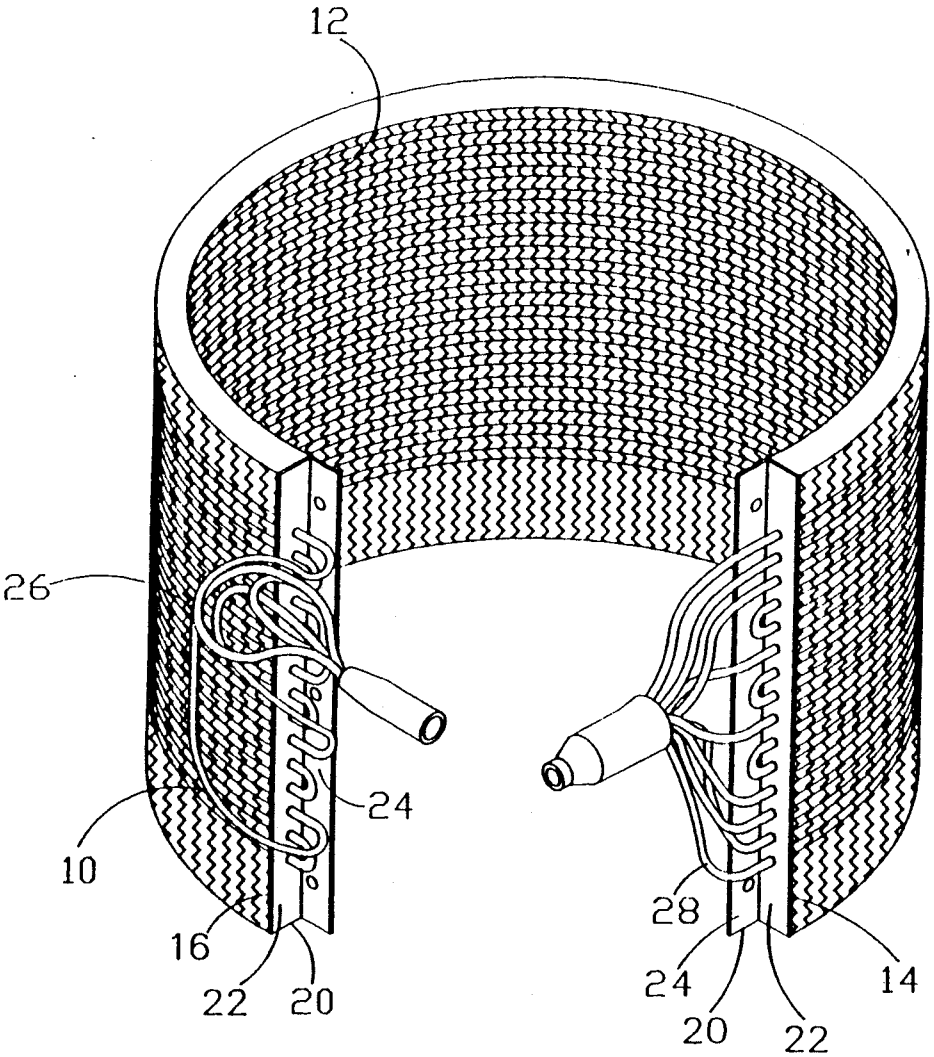
FIG. 3 shows a heat exchanger element of the prior art which is bent from a generally flat shape into a generally cylindrical shape with end surfaces disposed in a generally parallel relation with each other with a space therebetween.

FIG. 3 shows a generally cylindrical heat exchanger made in accordance with techniques known to those skilled in the art. The generally planar heat exchanger element of FIG. 1 has been bent about a central axis. The tubes 10 and heat exchanger fins 12 are formed into the generally cylindrical configuration shown in FIG. 3. The brackets, 18 and 20, are attached to the end surfaces of the heat exchanger element and the end surfaces of the heat exchanger element are associated in a generally parallel configuration with a space disposed therebetween. FIG. 3 illustrates the relaxed shape of the bent heat exchanger element. In order to attach the end surfaces of the heat exchanger together and constrict the heat exchanger assembly into a cylindrical shape, the extension portions 24 of the brackets, 18 and 20, must be held together in some manner.

It should be noted that, in FIG. 3, numerous U-shaped tube members are used to interconnect preselected tubes 10 and additional components, such as tubing 26 and 28, are shown attached to the heat exchanger. These additional components are not closely related to the present invention and will not be described in detail herein.

Figure 4:
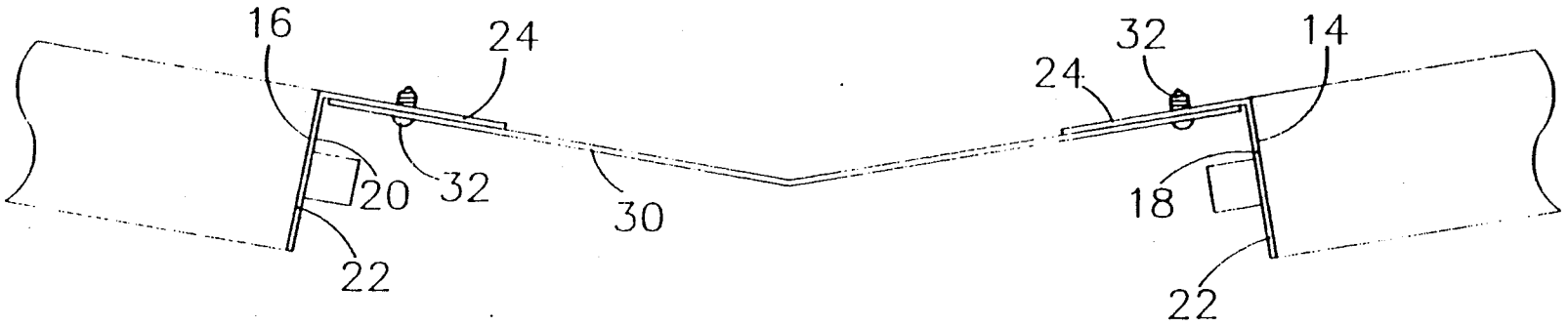
FIG. 4 shows the brackets of the heat exchanger assembly of the prior art with an additional connector plate and sheet metal screws.

FIG. 4 shows the end surfaces, 14 and 16 of the heat exchanger shown in FIG. 3. For purposes of clarity and simplicity, the U-shaped tube components are not shown in FIG. 4. As can be seen, the brackets 18 and 20, are each provided with a first segment 22 and a second segment 24 with the second segment 24 extending at some preselected angle from the first segment 22. The brackets, 18 and 20, are mechanically held together through the use of an additional component, such as the connector plate 30. The connector plate 30 is mechanically attached to the brackets by use of sheet metal screws 32. Each of the brackets, 18 and 20, is mechanically connected to the connector plate 30 by approximately three or more sheet metal screws. Before describing the advantages of the present invention, specific attention is directed to FIG. 4 and the illustrated requirement of a connector plate 30 and a plurality of sheet metal screws 32 to maintain the end portions, 14 and 16, of the heat exchanger element in the appropriate association with each other to form the cylindrical heat exchanger.

Figure 5:
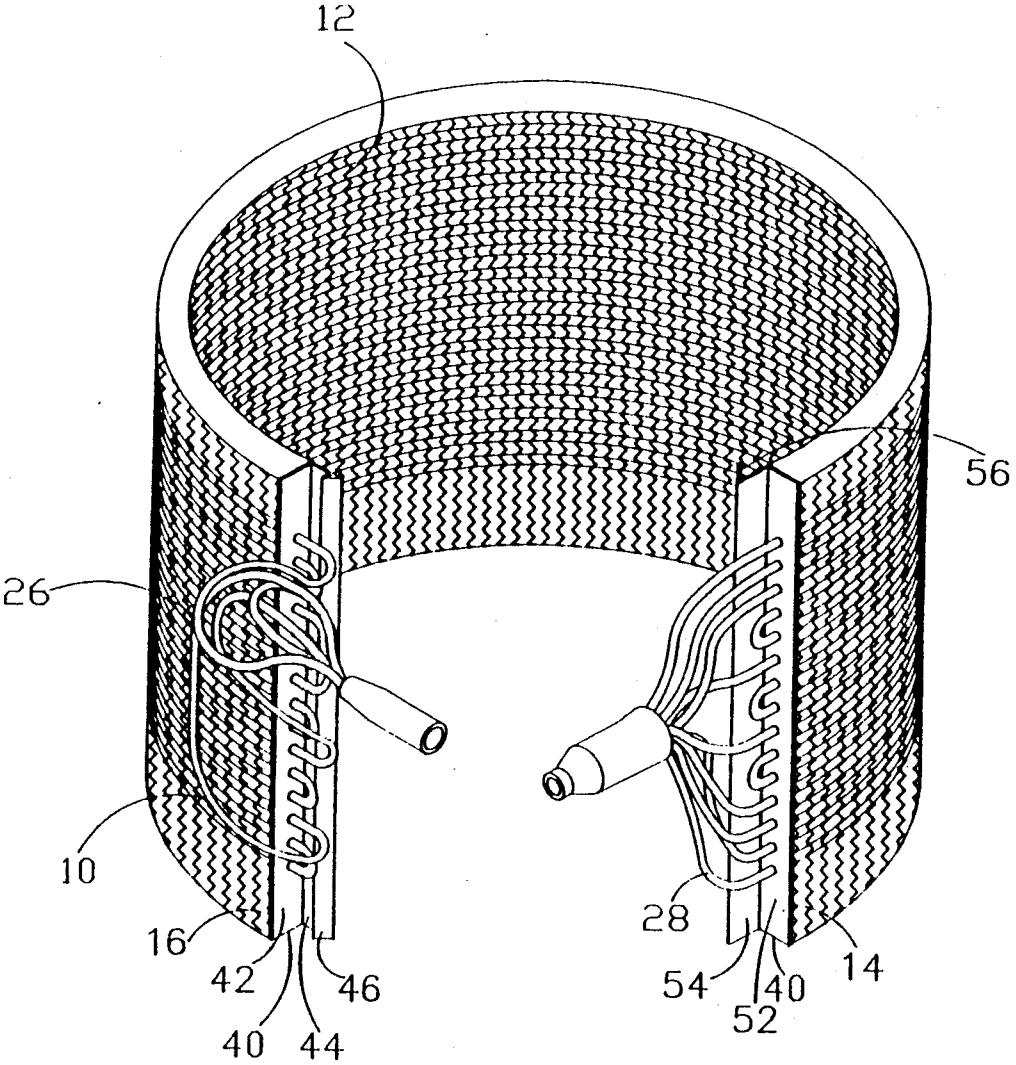
FIG. 5 shows a generally cylindrical heat exchanger made within the scope of the present invention.
Figure 6:
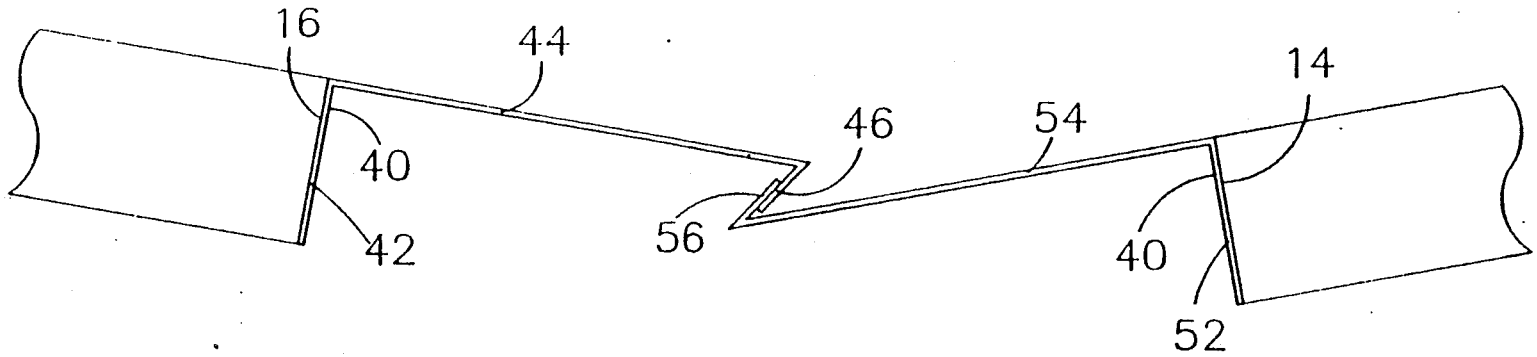
FIG. 6 shows the brackets of the present invention associated in an interlocking relationship with each other.

FIG. 5 shows a "O" coil heat exchanger made in accordance with the present invention. By comparing FIGS. 3 and 5, the distinctive differences between the present invention and the prior art can be seen. The brackets 40 of the present invention, which will be described in greater detail below in conjunction with FIG. 6, are shaped in a distinctively different manner from the brackets, 18 and 20, shown in FIG. 3. The other elements in FIG. 5 are generally similar to those in FIG. 3 and will not be described in detail herein.

FIG. 6 shows the end portions, 14 and 16 of the heat exchanger element with the brackets 40 of the present invention attached thereto. Since the two brackets 40 of the present invention are not exactly identical to each other, for reasons which will be described below, they will be described individually. The left bracket in FIG. 6 comprises a first portion 42, a second portion 44 and a third portion 46. The first portion 42 is attached to the end surface 16 of the heat exchanger element. It can be formed as an integral part of the heat exchanger element or, alternatively, can be mechanically attached to the end surface 16. The second portion 44 extends from the first portion 42 at a preselected angle to dispose it in an appropriate location for association with the other bracket. A third portion 46 of the bracket is disposed at a second preselected angle relative to the second portion 44. As can be seen, the angle between the second portion 44 and the third portion 46 forms a hook-like element which is shaped to receive a similarly configured segment of the other bracket.

Also shown in FIG. 6 is the other bracket 40 which comprises a first portion 52 which is attached to the end surface 14 of the heat exchanger element. A second portion 5 extends from the first portion 52 at a first preselected angle preferably an angle from 10° to 30° inclusive. The third portion 56 of the bracket is bent to extend at a second preselected angle preferably from 0° to 90° inclusive, and even more preferably from 0° to 45° inclusive from the second portion 54. As can be seen in FIG. 6, the third portions, 46 and 56 of the two brackets extend in opposite directions from each other so that they can receive each other in a self locking, or interlocking, relationship brackets can either be integrally formed with the heat exchanger or separately attachable.

With continued reference to FIG. 6 and with additional reference to FIG. 5, it can be seen that the third portions, 46 and 56, of the brackets are shaped to interlock when the end surfaces, 14 and 16, of the heat exchanger element are forced toward each other by applying a compressive force to distort the heat exchanger and reduce its effective diameter When the third portions, 46 and 56 are pushed toward and eventually past each other, they pass over each other because of the angle of the third portions with respect to their associated second portions, 44 and 54, and snap together Each of the third portions 46 and 56, are specifically shaped to receive each other in this interlocking association. When the compressive force is released, the heat exchanger will attempt to return to its relaxed shape that is shown in FIG. 5. The cooperative angles of the third portions, 46 and 56, of the brackets of the present invention prevent this return, as shown in FIG. 6, and limit the heat exchanger to a partial return toward that relaxed shape. As a result, the heat exchanger continues to apply a force which attempts to pull the two brackets apart but, instead, results in holding the two brackets in the interlocking relationship described above. This maintains the relative positions of the end surfaces, 14 and 16, at the desired position and maintains the heat exchanger assembly in a generally cylindrical shape.

Figure 7:
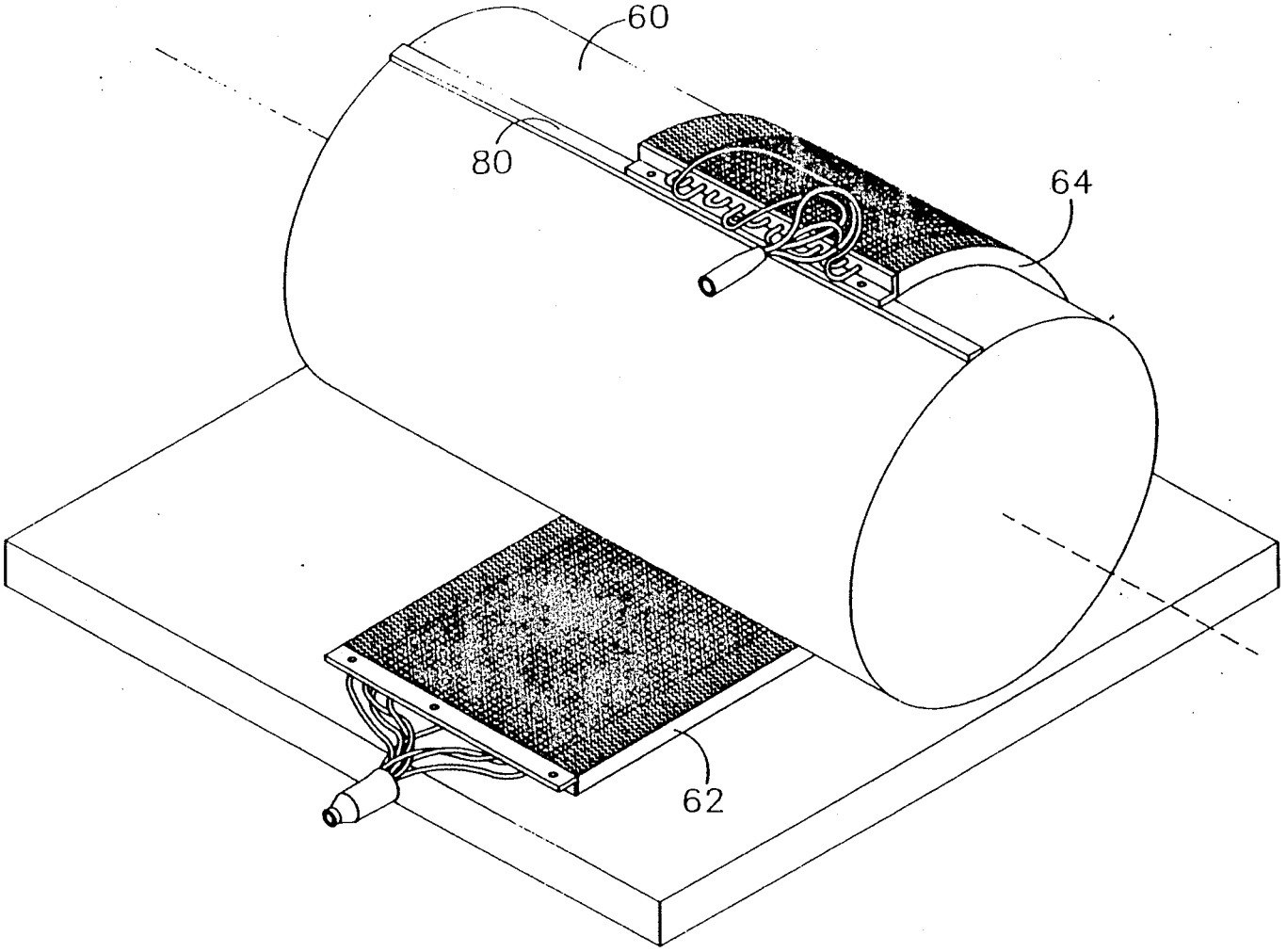
FIG. 7 shows a common method used to bend a generally planar heat exchanger element into a cylindrical shape.
Figure 8:
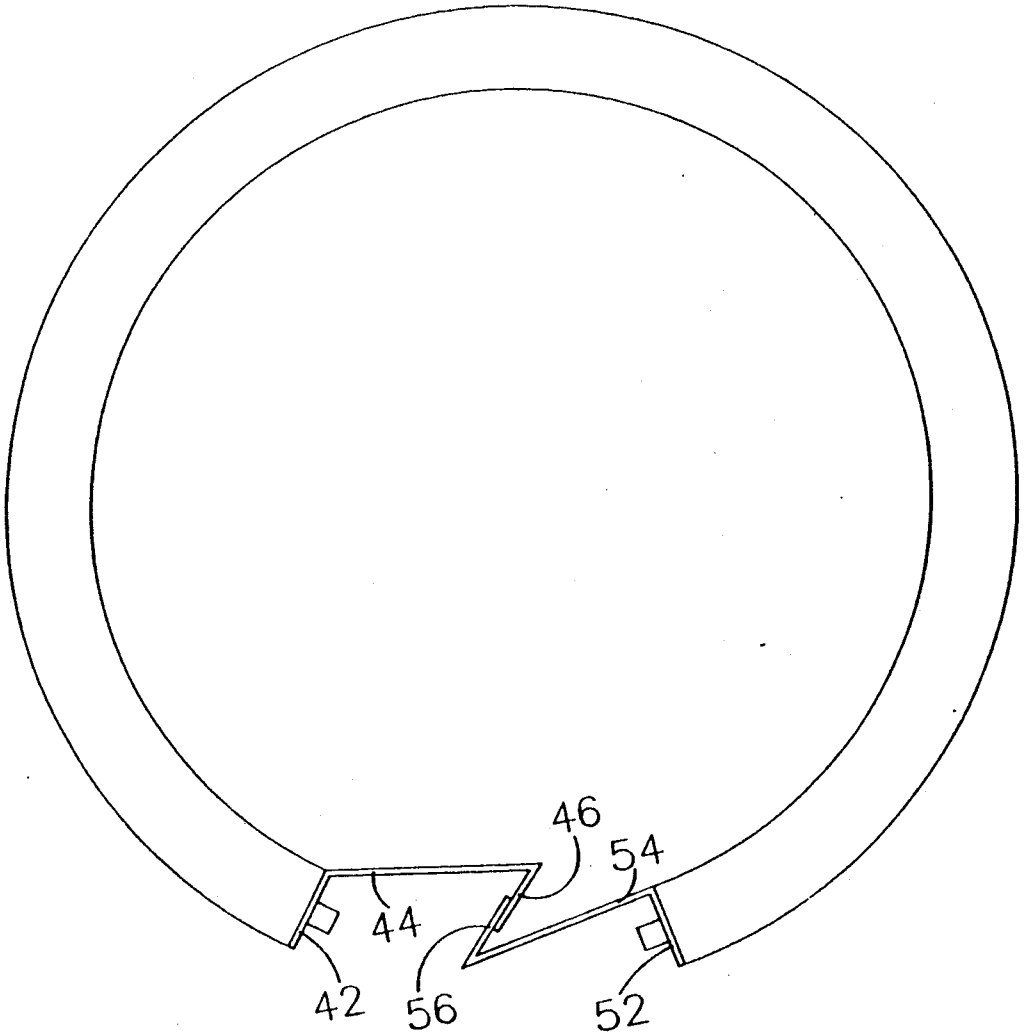
FIG. 8 shows an end view of a heat exchanger made in accordance with the present invention.

As described above, the present invention is applicable to heat exchangers that are formed by bending a planar heat exchanger element into a generally cylindrical shape. This technique is well known to those skilled in the art and is illustrated in FIG. 7. In a typical manufacturing process of this type, a drum 60 is used to roll, or bend, the heat exchanger element identified by reference numeral 62 around a central axis which, in this case, is coincident with the axis of rotation of the drum 60. As the drum 60 continues to rotate about its central axis, the generally planar heat exchanger 62 is bent into the shape illustrated by reference numeral 64. When the process shown in FIG. 7 is complete, the heat exchanger is formed into the shape shown in both FIGS. 3 and 5. The shape is not a complete cylinder but, instead, comprises a slightly larger diameter because of the relaxed shape of the heat exchanger. However, it should be understood that the heat exchangers shown in FIGS. 3 and 5 can be compressed to form a cylinder. When compressed in this manner, some means can be used to attach the end surfaces of the heat exchanger elements together to maintain this generally cylindrical shape. FIG. 8 shows the cylindrical shape of the heat exchanger after connecting the brackets of the present invention together in an interlocking relationship. In summary, the heat exchanger element, with its tubes 10 and fins 12, is bent into a generally cylindrical shape which is further held in a more cylindrical form by the action of the brackets.

While the most apparent advantages of the present invention have been described above, it should also be understood that additional advantages can be achieved through its use. For example, during manufacturing of the planar heat exchanger element, it is often painted and cleaned by a degreasing operation. The angle between the third portion, 46 and 56, and the second portion, 44 and 54, of the brackets of the present invention create a hook that can be used to support the heat exchanger element when in a planar shape and when being painted or cleaned. This hook provides an incidental benefit that is not available in heat exchangers using the prior art brackets that are shown in FIG. 4. In addition, while bending the planar heat exchanger into the generally cylindrical shape, the angle between the second and third portions of the brackets can be used to hold the heat exchanger element in position on the drum, such as the drum 60 in FIG. 7, while removing the necessity of providing additional fasteners between the heat exchanger and the drum. Although this specific adaptation is not particularly illustrated in FIG. 7, it should be understood that a minor adaptation to the drum, and more particularly, the strip 80 shown in FIG. 7, are relatively simple and easy to accomplish.

Although these additional advantages are also incumbent with the present invention, the most significant advantage can be seen by comparing FIGS. 4 and 6. In FIG. 4, the connector plate 30 is a necessary additional component required by the prior art devices. In addition, the plurality of sheet metal screws 32 are also required. These additional components require significant time to fabricate and assemble and require the additional storage of these parts prior to and during assembly.

Another significant advantage of the present invention is related to the fact that the compressing operation, by which the heat exchanger shown in FIGS. 3 and 5 is bent to form a cylindrical heat exchanger, requires some type of fixture to hold the heat exchanger in the deformed shape while an operator assembles the connector plate 30 to the brackets with the sheet metal screws 32. One operator cannot easily maintain the compressive force on the heat exchanger while assembling these numerous parts together In comparison, the heat exchanger made in accordance with the present invention can be assembled without the need of an additional fixture to hold the heat exchanger during the application of the compressive force. Instead, since the brackets of the present invention are interlocking in an automatic manner, the compressive force can be applied without the additional need of a fixture and the end surfaces, 14 and 16 can be pushed together by reducing the diameter of the assembly and causing the third portions, 46 and 56, to move toward and eventually past each other because of the ramp angle provided in the third portions of the brackets. After passing over each other, by slightly over-bending the assembly during the compressive deformation, the third portions snap together and capture each other. This prevents the heat exchanger assembly from completely returning toward its relaxed shape. Therefore, the assembly operation that attaches the two brackets together in a device made in accordance with the preferred embodiment of the present invention, merely requires the compression of the heat exchanger in a single step operation. No additional fasteners or connector plates are necessary and no additional holding fixture is usually needed.

While the preferred embodiment of the present invention has been described in explicit detail and illustrated with considerable specificity, it should be clearly understood that alternative embodiments of the present invention are to be considered within it scope.

What I claim is:

1. A heat exchanger assembly, comprising:

A heat exchanger element having two end surfaces, said heat exchanger element being bent to form a generally cylindrical member with said to end surfaces being disposed in generally parallel association with each other;

a first mounting bracket attached to a first one of said two end surfaces; and a second mounting bracket attached to a second one of said two end surfaces, said first and second mounting brackets each having first, second and third portions, said first portion being attached to an associated one of said end surfaces, said second portion extending from said first portion at a first preselected angle and said third portion extending from said second portion at a second preselected angle, said third portion of said first bracket and said third portion of said second bracket extending in generally opposite directions to form an interlocking association with each other.

2. The assembly of claim 1, wherein:

said second preselected angle is an angle that is greater than or equal to zero degrees and less than ninety degrees.

3. The assembly of claim 1, wherein:

said first preselected angle is an angle that is greater than ten degrees and less than thirty degrees.

4. The assembly of claim 1, wherein:

said heat exchanger element comprises a plurality of heat exchanging fins attached to a plurality of tubes.

5. The assembly of claim 1, wherein:

said first and second brackets are separable components that are mechanically connected to said heat exchange element.

6. A heat exchanger assembly, comprising:

a heat exchanger element formed in a generally cylindrical shape, said element having a first end surface and a second end surface, said first and second end surfaces being disposed in a generally parallel association with each other;

a first bracket attached to said first end surface; and a second bracket attached to said second said first and second brackets being shaped to receive each other in self locking association to maintain said first and second end surfaces in a preselected spatial relationship with each other.

7. The assembly of claim 6, wherein:

said generally cylindrical shape is formed by bending a generally flat heat exchanger component about a central axis.

8. The assembly of claim 7, wherein:

said first and second brackets are each shaped to have a first portion attached to said heat exchanger element, a second Portion extending from said first portion at a first preselected angle and a third portion extending from said second portion at a second preselected angle.

9. The assembly of claim 8, wherein:

said first preselected angle is between ten and thirty degrees, inclusively.

10. The assembly of claim 8, wherein:

said second preselected angle is between zero and ninety degrees, inclusively, measured between said second and third portions.

11. The assembly of claim 10, wherein:

said second preselected angle is between zero and forty five degrees, inclusively, measured between said second and third portions.

* * * * *